US009307607B2

(12) United States Patent
Tada

(10) Patent No.: US 9,307,607 B2
(45) Date of Patent: Apr. 5, 2016

(54) LIGHT SOURCE APPARATUS AND CONTROL METHOD THEREOF

(71) Applicant: CANON KABUSHIKI KAISHA, Tokyo (JP)

(72) Inventor: Mitsuru Tada, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 243 days.

(21) Appl. No.: 14/040,885

(22) Filed: Sep. 30, 2013

(65) Prior Publication Data

US 2014/0091715 A1 Apr. 3, 2014

(30) Foreign Application Priority Data

Oct. 1, 2012 (JP) ..... 2012-219400

(51) Int. Cl.

| | |
|---|---|
| ***H05B 37/02*** | (2006.01) |
| ***H05B 33/08*** | (2006.01) |
| ***G09G 3/00*** | (2006.01) |
| ***G09G 3/34*** | (2006.01) |

(52) U.S. Cl.

CPC ..... *H05B 33/0854* (2013.01); *G09G 3/00* (2013.01); *G09G 3/3426* (2013.01); *H05B 33/086* (2013.01); *H05B 33/0872* (2013.01); *G09G 2320/0242* (2013.01); *G09G 2320/0666* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 8,634,021 | B2 * | 1/2014 | Kawakami | 348/371 |
| 2007/0159448 | A1 * | 7/2007 | Inuzuka et al. | 345/102 |
| 2009/0079769 | A1 * | 3/2009 | Iisaka et al. | 345/693 |
| 2009/0207462 | A1 * | 8/2009 | Arimoto et al. | 358/509 |

FOREIGN PATENT DOCUMENTS

| | | | |
|---|---|---|---|
| JP | 2008-040073 | A | 2/2008 |
| JP | 2010-002494 | A | 1/2010 |
| WO | 03/077013 | A2 | 9/2003 |

* cited by examiner

*Primary Examiner* — Cassandra Cox

(74) *Attorney, Agent, or Firm* — Carter, DeLuca, Farrell & Schmidt, LLP

(57) ABSTRACT

A light source apparatus according to the present invention comprises: a brightness determination unit configured to determine emission brightness of each of light emission areas; a color determination unit configured to determine, for each of the light emission areas, an emission color of a target light, emission area, which is the each light emission area, based on the determined emission brightness of each of the light emission areas, in such a manner as to suppress a change in color of the target light emission area that is caused as a result of changes in emission brightnesses of light emission areas other than the target light emission area; and a control unit configured to cause each of the light emission areas to emit light of the determined emission color, at the determined emission brightness.

13 Claims, 10 Drawing Sheets

FIG. 6

COLUMN

| | 1 | 2 | 3 | ... | N |
|---|---|---|---|---|---|
| 1 | 1 | 0.5 | 0.25 | ... | 0.001 |
| 2 | 0.5 | 0.5 | 0.2 | ... | 0.001 |
| 3 | 0.25 | 0.2 | 0.15 | ... | 0.001 |
| ... | ... | ... | ... | ... | ... |
| M | 0.001 | 0.001 | 0.001 | ... | 0.001 |

ROW

LIGHT SOURCE APPARATUS AND CONTROL METHOD THEREOF

BACKGROUND OF THE INVENTION

1. Field of the Invention

The present invention relates to a light source apparatus and a control method thereof.

2. Description of the Related Art

A light source apparatus comprising a plurality of light emission areas individually capable of controlling the emission brightness thereof has been known as a backlight of a liquid crystal display apparatus. There is also a technology for controlling the emission brightness of each light emission area in accordance with the degree of luminous intensity (level of brightness) of an input image signal. Such control is called "local dimming control." One of the light emission area has three types of light emitting diodes (LEDs) as light sources, such as a red LED, a green LED, and a blue LED.

Also, Japanese Patent Application Publication No. 2008-40073 and WO 2003/077013, for example, disclose conventional technologies for improving the color reproducibility of a display apparatus having an independent light source.

Japanese Patent Application Publication No. 2008-40073 discloses a technology pertaining to a projector that has a plurality of light sources generating different emission colors and a plurality of liquid crystal light bulbs corresponding to the plurality of light sources. The plurality of light bulbs modulate (transmit) light of the light sources, and the resultant transmittances are controlled in response to image signals. The technology disclosed in Japanese Patent Application Publication No. 2008-40073 controls the emission brightness of each of the plurality of light sources in response to an input image signal and then corrects a gradation value of the input image signal in such a manner that the relationship between the gradation value of the input image signal and the brightness (relatively value) of the projector becomes equivalent among the light sources.

WO 2003/077013 discloses a technology for calculating an intensity distribution of the light from a light source by means of a known method (e.g., a method using a function describing how the light of the light source diffuses) and correcting an image signal based on the calculated intensity distribution.

Incidentally, the light from light emission areas diffuses, reflects and gets mixed inside a light source apparatus. For this reason, the colors of the light emission areas are determined by the mixed light. When the wavelength (emission wavelength) and the brightness (emission brightness) of the light generated by each light emission area are equal to each other, the color of the mixed light becomes even among the light emission areas. However, due to individual differences between light emitting elements such as LEDs, dispersion on manufacture and the like cause the variation in emission wavelengths, even -when the LEDs of the same type are used (LEDs emitting the same color). Such variation in emission wavelengths causes color unevenness (variation in the mixed light) in the light emission areas. Moreover, this color unevenness fluctuates depending on the emission brightness of the light emission areas.

Changes in colors of the light emission areas caused by changes in emission brightness thereof are described with reference to FIGS. 9A and 9B.

FIGS. 9A and 9B are diagrams schematically showing how the colors of three light emission areas change, the light emission areas being arranged in one direction.

FIG. 9A shows an example in which all of the light emission areas are caused to emit light at the same emission brightness (sufficiently high emission brightness; first emission brightness). Light emission areas 901, 902, 903 each have three LEDs as light sources: a red LED, a green LED, and a blue LED.

A brightness distribution 921*a* indicates a brightness distribution (simple brightness distribution) obtained when only the light emission area 901 is caused to emit light at the first emission brightness. A brightness distribution 922*a* indicates a brightness distribution obtained when only the light emission area 902 is caused to emit light at the first emission brightness. A brightness distribution 923*a* indicates a brightness distribution obtained when only the light emission area 903 is caused to emit light at the first emission brightness.

A brightness distribution 920*a* indicates a brightness distribution (synthetic brightness distribution) obtained when the light emission areas 901, 902, 903 are caused to emit light at the first emission brightness. In other words, the brightness distribution 920*a* is obtained by synthesizing the brightness distributions 921*a*, 922*a*, 923*a*. Because the light emission areas 901, 902, 903 have the same emission brightness, the brightness distribution 920*a* has a flat brightness distribution.

An emission wavelength 911*a* indicates a spectrum (simple spectrum) of the light emitted only by the light emission area 901 at the first emission brightness. An emission wavelength 912*a* indicates a spectrum of the light emitted only by the light emission area 902 at the first emission brightness. An emission wavelength 913*a* indicates a spectrum of the light emitted only by the light emission area 903 at the first emission brightness. In the emission wavelength 912*a*, the reference position shown by a dashed line exactly overlaps with the center of the entire emission wavelength interval. The emission wavelength 911*a* is a spectrum obtained by shifting the emission wavelength 912*a* towards the shorter wavelengths. The emission wavelength 913*a* is a spectrum obtained by shifting the emission wavelength 912*a* towards the longer wavelengths. Such spectra change randomly, which occurs due to individual differences between the LEDs.

A wavelength 931*a* indicates the color of the light emission area 901 obtained when the light emission areas 901, 902 and 903 are caused to emit light at the first emission brightness. Specifically, the wavelength 931*a* indicates a spectrum (synthetic spectrum) of the synthetic light (mixed light) generated in the light emission area 901 when the light, emission areas 901, 902 and 903 are caused to emit light at the first emission brightness. A wavelength 932*a* indicates a spectrum of synthetic light generated in the light emission area 902 when the light emission areas 901, 902 and 903 are caused to emit light at the first emission brightness. A wavelength 933*a* indicates a spectrum of synthetic light generated in the light emission area 903 when the light emission areas 901, 902 and 903 are caused to emit light at the first emission brightness. The wavelengths 931*a*, 932*a* and 933*a* are spectra that are substantially equal to one another due to the influence of light from other light emission areas. Thus, such color unevenness described above does not occur in these areas.

FIG. 9B shows an example in which the emission brightness of the light emission areas 901 and 903 is set at the first emission brightness and the emission brightness of the light emission area 902 is set at second emission brightness lower than the first emission brightness.

A brightness distribution 921*b* is obtained when only the light emission area 901 is caused to emit light at the first emission brightness. A brightness distribution 922*b* is obtained when only the light emission area 902 is caused to emit light at the second emission brightness. A brightness distribution 923*b* is obtained when only the light emission area 903 is caused to emit light at the first emission brightness.

A brightness distribution 920*b* is obtained when the light emission areas 901 and 903 are caused to emit light at the first emission brightness and the light emission area 902 is caused to emit light at the second emission brightness. In other words, the brightness distribution 920*b* is obtained by synthesizing the brightness distributions 921*b*, 922*b* and 923*b*. Because the emission brightness of the light emission area 902 is lower than those of the light emission areas 901 and 903, the brightness distribution 920*b* has the brightness decreasing on the light emission area 902.

An emission wavelength 911*b* indicates a spectrum of light emitted only by the light emission area 901 at the first emission brightness. An emission wavelength 912*b* indicates a spectrum of light emitted only by the light emission area 902 at the second emission brightness. An emission wavelength 913*b* indicates a spectrum of light emitted only by the light emission area 903 at the first emission brightness. As with FIG. 9A, in the emission wavelength 912*b*, the reference position shown by a dashed line exactly overlaps with the center of the entire emission wavelength interval. The emission wavelength 911*b* is a spectrum obtained by shifting the emission wavelength 912*b* towards the shorter wavelengths. The emission wavelength 913*b* is a spectrum obtained by shifting the emission wavelength 912*b* towards the longer wavelengths.

A wavelength 931*b* indicates a spectrum of the synthetic light generated in the light emission area 901 when the light emission areas 901 and 903 are caused to emit light at the first emission brightness and the light emission area 902 is caused to emit light at the second emission brightness. A wavelength 932*b* indicates a spectrum of synthetic light generated in the light emission area 902 when the light emission areas 901 and 903 are caused to emit light at the first emission brightness and the light emission area 902 is caused to emit light at the second emission brightness. A wavelength 933*b* indicates a spectrum of synthetic light generated in the light emission area 903 when the light emission areas 901 and 903 are caused to emit light at the first emission brightness and the light emission area 902 is caused to emit light at the second emission brightness. Because the emission brightness of the light emission area 902 is low, the light of the light emission area 902 does not so much leak to the other light emission areas. Therefore, the spectra of the wavelengths 931*a*, 932*a* and 933*a* are different from one another, causing the color unevenness described above. Due to such a color change, the colors of the image displayed by the display apparatus fluctuate, lowering its color reproducibility.

Unfortunately, these conventional technologies do not take such color unevenness (changes in colors of light emitted by the other light emission areas) into consideration. Thus, the use of such conventional technologies cannot contribute to suppression of changes in colors of the light emission areas or reduction of color reproducibility.

SUMMARY OF THE INVENTION

The present invention provides a technology capable of inhibiting a change in color of each light emission area that is caused as a result of a change in emission brightness of each light emission area.

The present invention in its first aspect provides a light source apparatus formed of a plurality of light emission areas capable of individually controlling emission brightness and emission colors thereof, the light source apparatus comprising:

a brightness determination unit configured to determine emission brightness of each of the light emission areas;

a color determination unit configured to determine, for each of the light emission areas, an emission color of a target light emission area, which is the each light emission area, based on the emission brightness of each of the light emission areas determined by the brightness determination unit, in such a manner as to suppress a change in color of the target light emission area that is caused as a result of changes in emission brightnesses of light emission areas other than the target light emission area; and a control unit configured to cause each of the light emission areas to emit light of the emission color determined by the color determination unit, at the emission brightness determined by the brightness determination unit.

The present invention in its second aspect provides a control method of a light source apparatus formed of a plurality of light emission areas capable of individually controlling emission brightness and emission colors thereof, the control method comprising:

determining emission brightness of each of the light emission areas;

determining, for each of the light emission areas, an emission color of a target light emission area, which is the each light emission area, based on the determined emission brightness of each of the light emission areas, in such a manner as to suppress a change in color of the target light emission area that is caused as a result of changes in emission brightnesses of light emission areas other than the target light emission area; and causing each of the light emission areas to emit light of the determined emission color, at the determined emission brightness.

The present invention can suppress a change in color of each light emission area that is caused as a result of a change in emission brightness of each light emission area.

Further features of the present invention will become apparent from the following description of exemplary embodiments with reference to the attached drawings.

BRIEF DESCRIPTION OF THE DRAWINGS

FIG. 6 is a diagram showing an example of a decay rate shown in each of light emission areas that is generated clue to light emitted by a light emission area in the 1st row and 1st column;

DESCRIPTION OF THE EMBODIMENTS

Embodiment 1

A light source apparatus and its control method according to Embodiment 1 of the present invention are now described hereinafter. The light source apparatus according to the present embodiment is formed of a plurality of light emission areas capable of individually controlling the emission brightness (emission luminance) and emission colors thereof.

Note that the present embodiment describes an example of a display apparatus having the light source apparatus (the independent light source); however, the light source apparatus is not limited to the one used in the display apparatus. The light source apparatus may be indoor lighting or a streetlight.

Figure 1:
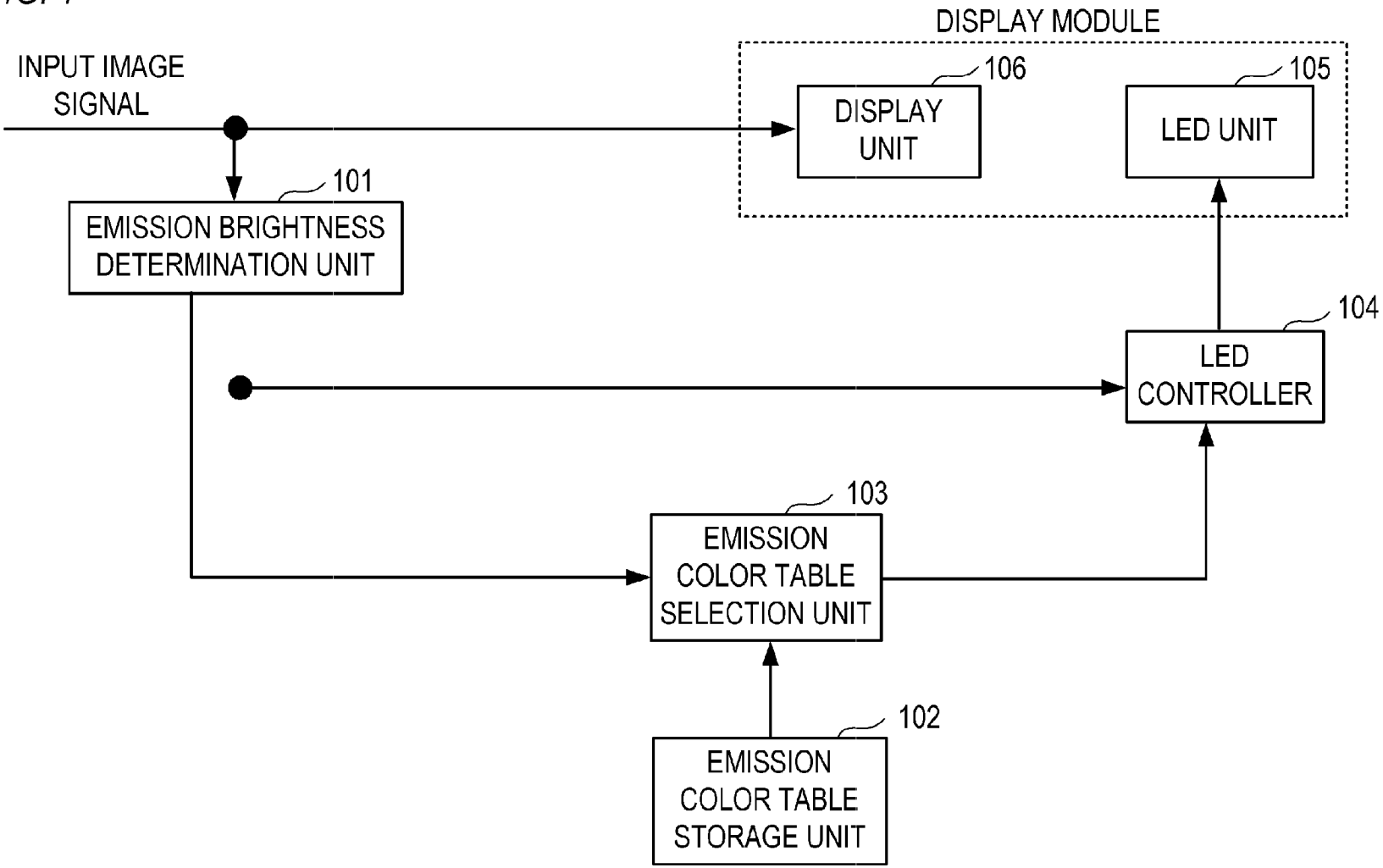
FIG. 1 is a block diagram showing an example of a schematic configuration of a display apparatus according to Embodiment 1.

FIG. 1 is a block diagram showing an example of a schematic configuration of the display apparatus according to the present embodiment.

As shown in FIG. 1, the display apparatus according to the present embodiment has an emission brightness determination unit 101, an emission color table storage unit 102, an emission color table selection unit 103, an LED controller 104, an LED unit 105, a display unit 106, and the like.

The LED unit 105 is configured by a plurality of light sources provided in light emission areas respectively. In the present embodiment, a plurality of light emitting elements generating different emission colors are provided as the light sources in each of the light emission areas. Specifically, a plurality of light emitting diodes (LEDs) that emit light of different wavelengths are provided as the light sources in each of the light emission areas. More specifically, three LEDs, a red LED emitting red light, a green LED emitting green light and a blue LED emitting blue light, are provided as the plurality of LEDs.

The display unit 106 displays an image on a screen thereof by transmitting light from, the LED unit 105 at a transmittance corresponding to an input image signal (or an image-processed input image signal). A liquid crystal panel or the like can be used as the display unit 106.

The emission brightness determination unit 101 determines emission brightness of each light emission area. In the present embodiment, the emission brightness of each light emission area is determined based on an input image signal. Note that the method for determining the emission brightness of each light emission area is not limited to the aforementioned method. For instance, the emission brightness of each light emission area may be determined in response to a user operation (an operation for lowering the emission brightness, an operation for increasing the emission brightness, and the like).

The LED controller 104 determines an emission color (color determination) of each light emission area based on the emission brightness of each light emission area determined by the emission brightness determination unit 101. In the present embodiment, for each light emission area, the emission color of a target light emission area, which is the each light emission area, is determined in such a manner as to compensate for a change in color of the target light emission area that is caused as a result of a change in emission brightness of the light emission areas other than the target light emission area. The term "light emission areas other than the target light emission area" may indicate all or some of the light emission areas other than the target light emission area. For instance, the "light, emission areas other than the target light emission area" may indicate the light emission areas located within a predetermined range of the target light emission area (the light emission areas away from the target light emission area by a predetermined distance or less).

The LED controller 104 causes each of the light emission areas to emit light of the determined emission color at the emission brightness determined by the emission brightness determination unit 101.

Note that the process for determining the emission color of each light emission area and the process for causing each of the light emission areas to emit light maybe executed by different function units.

The emission color table storage unit 102 stores emission color information that is prepared in advance. The emission color information indicates the emission color of each light emission area in accordance with a combination of emission brightness of light emission areas. Specifically, the emission color information indicates the emission color of each light emission area in accordance with each emission brightness combination in order to set a predetermined color for each light emission area. In the present embodiment, an emission color table representing the emission color of each light emission area is stored as the information indicating the emission color of each light emission area corresponding to a single emission brightness combination.

From among the emission color tables stored in the emission color table storage unit 102, the emission color table selection unit 103 selects an emission color table corresponding to a combination of emission brightness of light emission areas that is determined by the emission brightness determination unit 101. The emission color table selection unit 103 then outputs the selected emission color table to the LED controller 104.

The LED controller 10 4 consequently causes each of the light emission areas to emit light of the emission color selected by the emission color table selection unit 103 (the emission color represented by the emission color table selected by the emission color table selection unit 103) at the emission brightness determined by the emission brightness determination unit 101.

Specific examples of the processes executed by the emission brightness determination unit 101 are now described hereinafter.

In the present embodiment, the emission brightness determination unit 101 calculates an emission brightness control value bd corresponding to the emission brightness. The emission brightness control value bd is a control value based on which the emission brightness of each light emission area is controlled. In the present embodiment, an integer of 0 to 255 is set as the emission brightness control value bd. The emission brightness of each light emission area is controlled in such a manner that the emission brightness increases as the set emission brightness control value bd increases. In the present embodiment, the light source apparatus comprises light emission areas arranged in a M rows×N columns matrix. The emission brightness control value of the light emission area in the mth row and nth column is described as "bdmn." The emission brightness of the light emission area in the mth row and nth column is described as "BDmn."

The emission brightness determination unit 101 outputs the emission brightness control values of the respective light emission areas to the emission color table selection unit 103 and the LED controller 104.

Figure 2:
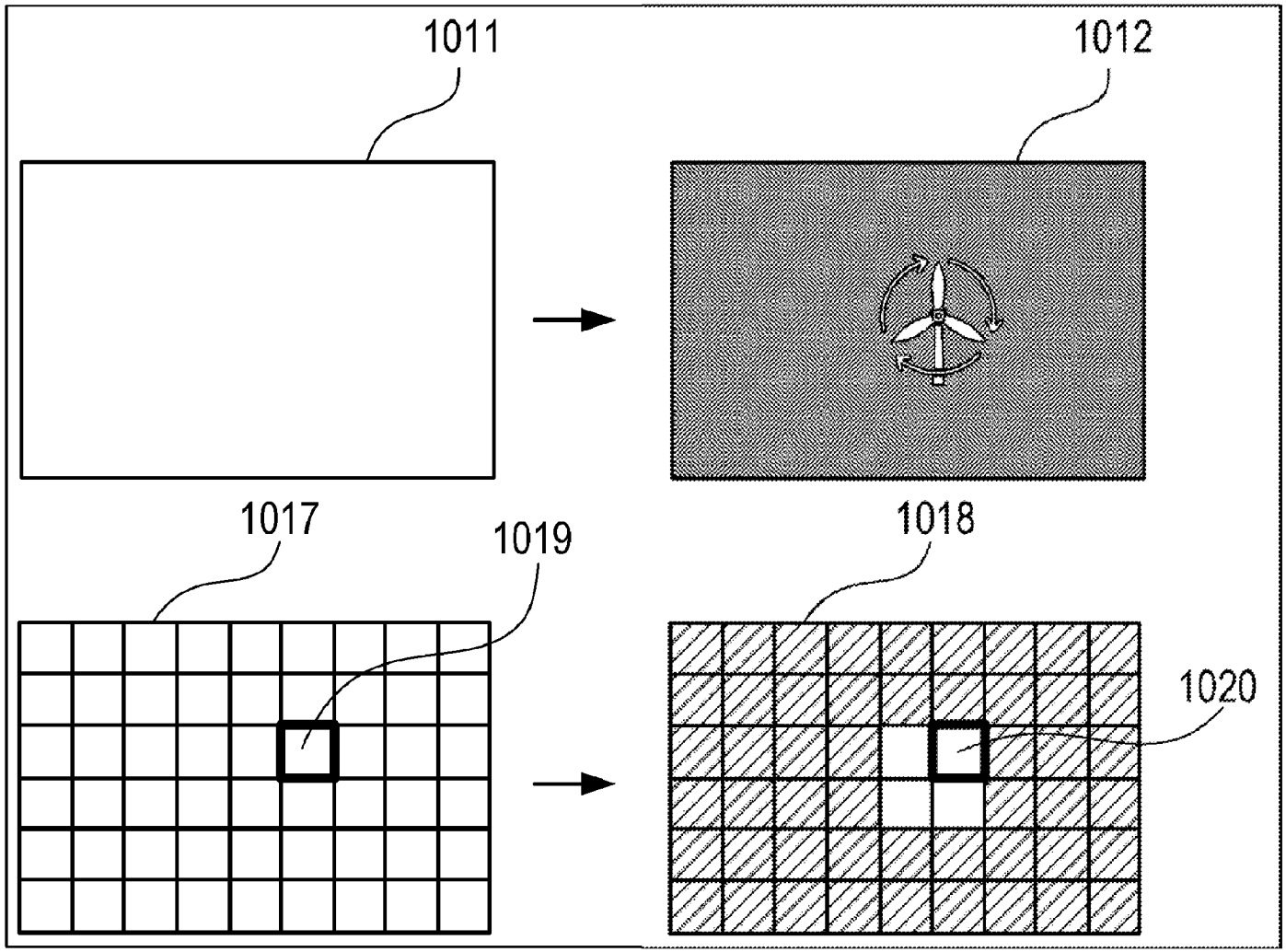
FIG. 2 is a diagram showing an example of a change in emission brightness that is caused as a result of a change of an input image signal.

FIG. 2 shows an example of a change in emission brightness that is caused as a result of a change of an input image signal.

An input image signal 1011 indicates a bright image of uniform brightness. An input image signal 1012 indicates an image that is partially bright (the windmill portion) and partially dark (the background).

When the input image signal 1011 is input, the emission brightness of each light emission area is set, as shown in an emission state 1017.

When the input image signal 1012 is input, the emission brightness of each light emission area is set, as shown in an emission state 1018.

In the emission states 1017, 1018, the areas surrounded by solid lines are the light emission areas. While the white light emission areas have high emission brightness, the areas with hatched lines are light emission areas with dark emission brightness (e.g., non-emission areas). Reference numerals 1019 and 1020 represent the identical light emission areas. The light emission areas 1019 and 1020 correspond to the windmill portion. The emission state 1017 represents a state in which all of the light emission areas emit light at high emission brightness. The emission state 1018 represents a state in which only the light emission areas corresponding to the windmill portion (four light emission areas located immediately below the areas displaying the windmill) emit light at high emission brightness.

Specific examples of the information stored in the emission color table storage unit 102 are now described.

As described above, the emission color table storage unit 102 stores the emission color tables with respect to the combinations of emission brightness (the emission brightness control values) of the light emission areas.

The emission color tables represent the emission colors of the respective light emission areas in order to set the color of each light emission area as a predetermined color. In the present embodiment, the emission color of each light emission area is expressed by the ratio of emission brightness among the plurality of light emitting elements of the light emission area (emission brightness ratio). In other words, each emission color table represents, for each of the light emission areas, the ratio among emission brightness ri of the red LED, emission brightness gi of the green LED, and emission brightness bi of the blue LED. The emission brightness of the red LED of the light emission area in the mth row and nth column is described as "rimn," the emission brightness of the green LED of the same as "gimn," and the emission brightness of the blue LED of the same as "bimn." A table value TBLmn of the light emission area in the mth row and nth column (the emission brightness ratio described above) is expressed as rimn:gimn:bimn. The emission brightness of each LED for satisfying the table value TBLmn and the emission brightness BDmn can be calculated using the following equations 1 to 3. The term RImn represents a brightness value corresponding to the red component of the light emitted by the light emission area in the mth row and nth column. In other words, the term RImn is the emission brightness of the red LED of the light emission area in the mth row and nth column. The term GImn represents the emission brightness of the green LED of the light emission area in the mth row and nth column. The term BImn represents the emission brightness of the blue LED of the light emission area in the mth row and nth column.

$$RImn=rimn/(rimn+gimn+bimn)\times BDmn \quad \text{(Equation 1)}$$

$$GImn=gimn/(rimn+gimn+bimn)\times BDmn \quad \text{(Equation 2)}$$

$$BImn=bimn/(rimn+gimn+bimn)\times BDmn \quad \text{(Equation 3)}$$

In the present embodiment, the emission color table storage unit 102 stores the emission color tables with respect to all combinations of emission brightness of the light emission areas. In other words, the emission color information indicates the emission color of each of the light emission areas with respect to all combinations of emission brightness of the light emission areas.

Specific examples of the processes executed by the emission color table selection unit 103 are now described.

Here, examples of setting the emission states 1017 and 1018 shown in FIG. 2 are described.

The emission color table selection unit 103 selects an emission color table corresponding to a combination of emission brightness (emission brightness control values) of each light emission area that is determined by the emission brightness determination unit 101. In a case where the emission state 1017 is set, an emission color table TBLa corresponding to the emission state 1017 is selected. In a case where the emission state 1018 is set, an emission color table TBLb corresponding to the emission state 1018 is selected. The emission color table selection unit 103 outputs the selected emission color tables to the LED controller 104.

Figure 3:
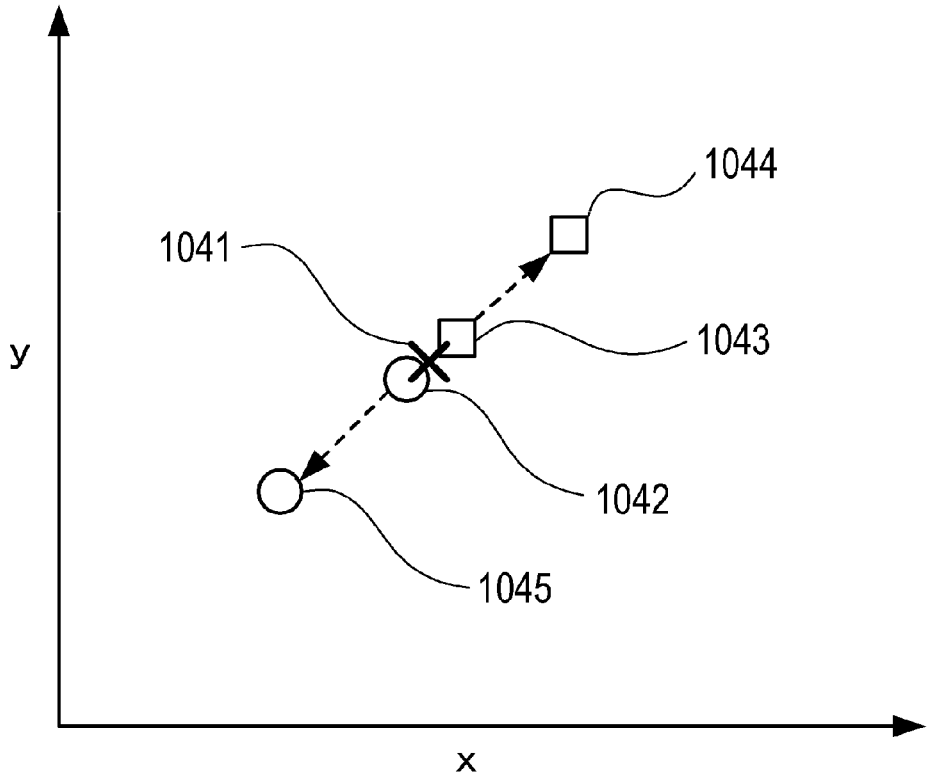
FIG. 3 is a diagram for explaining the effects of Embodiment 1.

The emission color table TBLa represents an emission brightness ratio of each light emission area based on which each light emission area is caused to emit light to obtain the emission state 1017, the emission brightness ratio being used to obtain a white light emission area. When the emission brightness of each light emission area is expressed by the emission state 1017 and the emission color of each light emission area (emission brightness ratio) is expressed by the emission color table TBLa, the chromaticity coordinate (color) of the light emission area 1019 becomes a chromaticity coordinate 1043 (FIG. 3).

The emission color table TBLb is the emission brightness ratio of each light emission area based on which each light emission area is caused to emit light to obtain the emission state 1018, the emission brightness ratio being used to obtain a white light emission area. When the emission brightness of each light emission area is expresses by the emission state 1018 and the emission color of each light emission area (emission brightness ratio) is expressed by the emission color table TBLb, the chromaticity coordinate (color) of the light emission area 1020 becomes a chromaticity coordinate 1042 (FIG. 3).

The chromaticity coordinate 1042 is extremely close to the chromaticity coordinate 1043. Specifically, the chromaticity coordinate 1042 and the chromaticity coordinate 1043 are extremely close to a chromaticity coordinate 1041 of a desired color (predetermined color: white, in the present embodiment). The color of each light emission area (color of synthesized light) can be approximated to the desired color by selecting the emission color table corresponding to the combination of emission brightness (emission brightness control value) of each light emission area determined by the emission brightness determination unit 101 and then controlling the emission color of each light emission area in accordance with the selected emission color table.

A conventional example in which the emission color of each light emission area is fixed is now described for a comparison purpose.

For example, suppose that, the emission color of each light emission area corresponds to the emission color table TBLb. In this case, the emission color of each light emission area (emission brightness ratio) is expressed by the emission color table TBLb when the emission brightness of each light emission area is expressed by the emission state 1017. As a result, the chromaticity coordinate (color) of the light emission area 1019 becomes a chromaticity coordinate 1044, differing significantly from the desired color (FIG. 3).

The same problem occurs in a case where the emission color of each light emission area corresponds to the emission color table TBLa. Specifically, when the emission brightness of each light emission area is expressed by the emission state 1018, the emission color (emission brightness ratio) of each light emission area becomes the emission color shown by the emission color table TBLa. Consequently, the chromaticity coordinate (color) of the light emission area 1020 becomes a chromaticity coordinate 1045, differing significantly from the desired color (FIG. 3).

Specific examples of the processes executed by the LED controller 104 are now described.

The LED controller 104 causes each of the light emission areas to emit light, based on the emission brightness control value bd of each light emission area and the emission color table selected by the emission color table selection unit 103.

Specifically, for each of the light emission areas, the LED controller 104 calculates a drive current value of each LED of each light emission area based on the emission brightness (emission brightness control value) and emission color (the table value of the emission color table; emission brightness ratio) of each light emission area. The LED controller 104 then runs the calculated drive current to each LED to cause each LED to emit light.

The drive current value of each LED of the light emission area in the mth row and nth column is calculated using, for example, the following equations 4 to 6. The term IDRmn represents the drive current value of the red LED of the light emission area located in the mth row and nth column. The term IDGmn represents the drive current value of the green LED of the light emission area located in the mth row and nth column. The term IDBmn represents the drive current, value of the blue LED of the light emission area located in the mth row and nth column. The term d bra ax represents the maximum of the values that can be set as the emission brightness control values. The term IRmax is the maximum value that can be set as the drive current value of the red LED. The term IGmax represents the maximum value that can be set as the drive current value of the green LED. The term IBmax represents the maximum value that can be set as the drive current value of the blue LED.

$$IDRmn=rimn/(rimn+gimn+bimn)\times bdmn/bdmax\times IRmax \quad \text{(Equation 4)}$$

$$IDGmn=gimn/(rimn+gimn+bimn)\times bdmn/bdmax\times IGmax \quad \text{(Equation 5)}$$

$$IDBmn=bimn/(rimn+gimn+bimn)\times bdmn/bdmax\times IBmax \quad \text{(Equation 6)}$$

According to the present embodiment, for each light emission area, the emission color of the target light emission area, which is the each light emission area, is determined based on the determined emission brightness of each light emission area, in such a manner as to compensate for a change in color of the target light emission area that is caused as a result of a change in emission brightness of light emission areas other than the target light emission area, as described above. Specifically, for each combination of emission brightness of the light emission areas, the emission color information indicating the emission color of each light emission area is prepared in advance. Of the emission colors of the light emission areas with respect to the combinations indicated by the emission color information, the emission color of each light emission area corresponding to the determined emission brightness combination of each light emission area is selected. Subsequently, each of the light emission areas is caused to emit light of the determined (selected) emission color at the determined emission brightness.

This can consequently suppress a change in color of each light emission area caused by the change in emission brightness of each light emission area.

In the present embodiment, the emission color tables (emission colors of the light emission areas) are prepared as the emission color information with respect to all combinations of emission brightness of the light emission areas; however, the emission color information is not limited thereto. The emission color tables may be prepared as the emission color information with respect to some of the combinations. In such a case, for instance, an emission color table corresponding to the combination most approximate to the determined emission brightness combination of each light emission area may be selected. Furthermore, the emission color table corresponding to the combination most approximate to the determined combination of emission brightness of each light emission area may be selected, and the emission brightness ratio corresponding to the determined combination of emission brightness of each light emission area may be calculated using the table value (emission brightness ratio) of the selected emission color table.

Embodiment 2

A light source apparatus and its control method according to an embodiment 2 of the present invention are now described hereinafter. Embodiment 1 has described an example in which the emission color tables (emission colors of the respective light emission areas) are prepared with respect to all combinations of emission brightness of the light emission areas. The present embodiment describes an example in which the emission color tables for some combinations are prepared and the emission brightness ratio corresponding to the determined combination of emission brightness of each light emission area is calculated using the prepared emission color tables.

Figure 4:
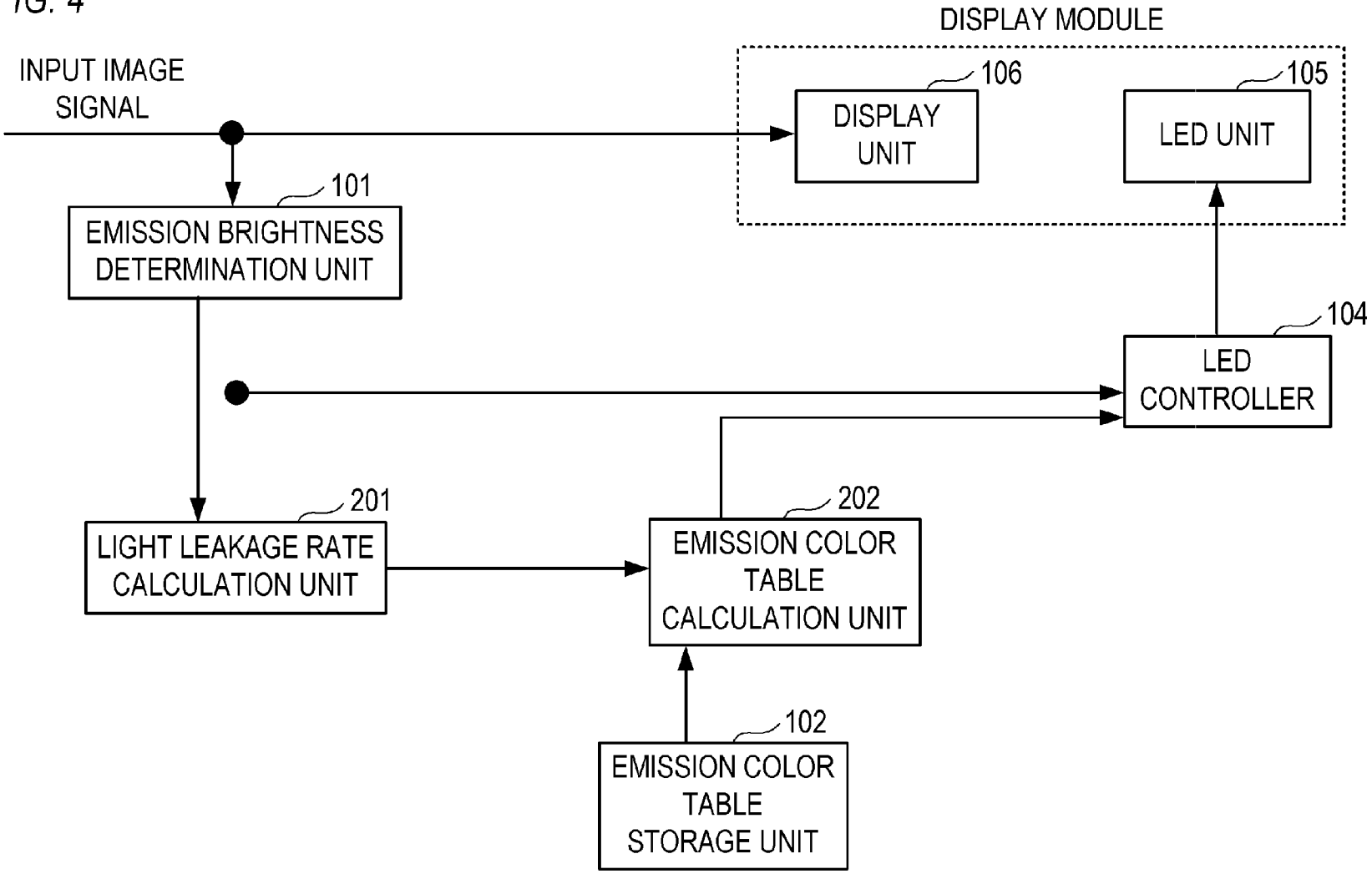
FIG. 4 is a block diagram showing an example of a schematic configuration of a display apparatus according to Embodiment 2.

FIG. 4 is a block diagram showing an example of a schematic configuration of a display apparatus according to the present embodiment. The same reference numerals are used for indicating the function units same as those described in Embodiment 1 (FIG. 1), and therefore the overlapping explanations are omitted accordingly.

The display apparatus according to the present embodiment has a light leakage rate calculation unit 201 and emission color table calculation unit 202 in place of the emission color table selection unit 103 shown in FIG. 1.

The light leakage rate calculation unit 201 calculates a light leakage rate $\alpha$ of each of the light emission areas based on the emission brightness of each of the light, emission areas that is determined by the emission brightness determination unit 101. The light leakage rate $\alpha$ of the target light emission area, the emission color of which is to be determined, represents the level of influence of light from the light emission areas other than the target light emission area, on the color of the target light emission area.

Specific examples of a method for calculating the light leakage rate $\alpha$ are now described.

Figure 5:
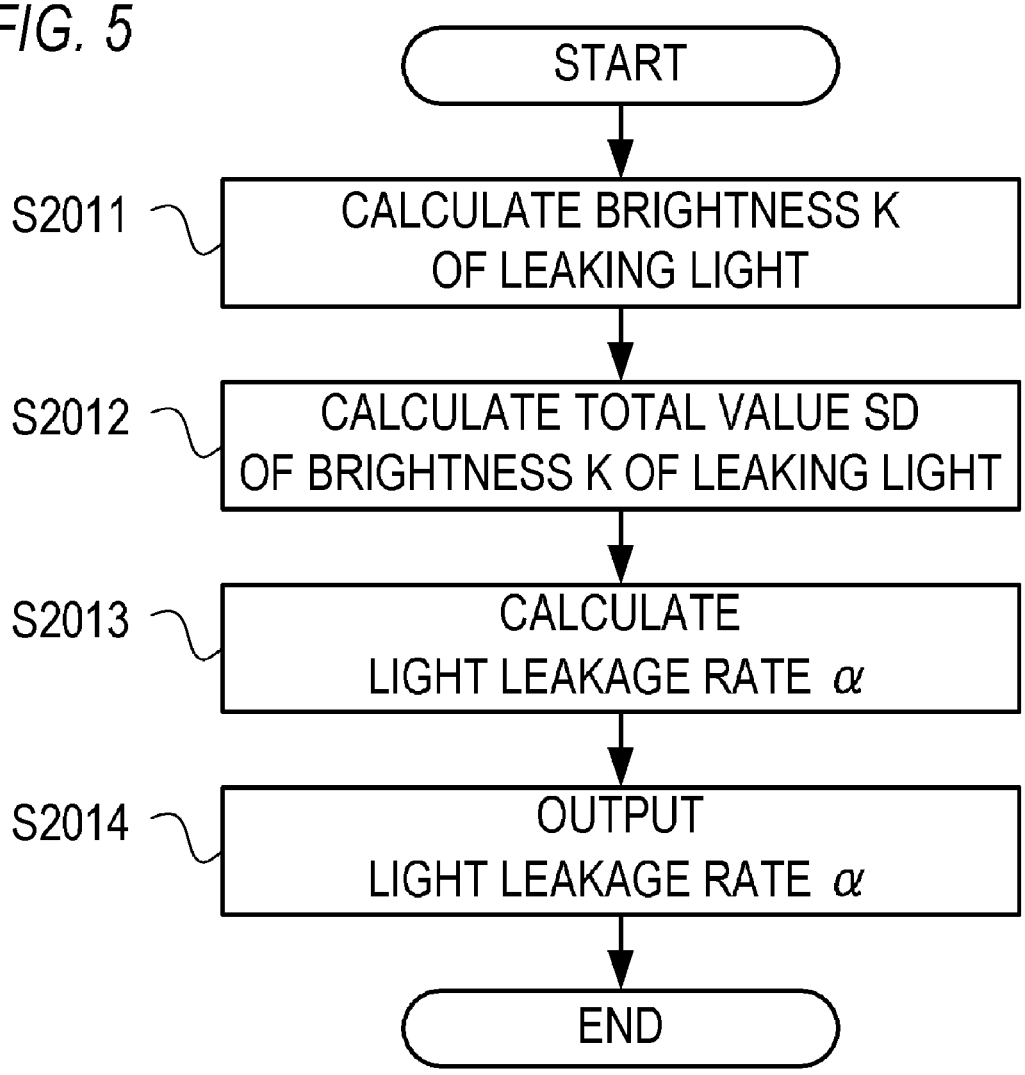
FIG. 5 is a flowchart showing an example of a flow of processes executed by a light leakage rate calculation unit.

FIG. 5 is a flowchart, showing an example of a flow of processes executed by the light leakage rate calculation unit 201.

The following describes a process flow for calculating a light leakage rate $\alpha mn$ of the target light emission area located in the mth row and nth column. The light leakage rate calculation unit 201 executes the following processes on all of the light emission areas.

First of all, in S2011 the light leakage rate calculation unit 201 calculates brightness of the target light emission area that is generated due to the light emitted from the light emission areas other than the target light emission area (light leakage brightness). In the present embodiment, diffusion information is prepared in advance, the diffusion information indicating how the light from the light emission areas diffuses. The brightness of the target light emission area that is generated due to the light emitted from the light emission areas other than the target light emission area is calculated from the emission brightness of each of the light emission areas determined by the emission brightness determination unit 101 and the diffusion information. Specifically, for each of the light emission areas other than the target, light emission area, the brightness of the target light emission area that is generated due to the light emitted from these light emission areas is calculated using the following equation 7. In Equation 7, the term Kmnm'n' represents the brightness of the light emission area in the mth row and nth column, generated due to the light emitted from the light emission area located in the m'th row and n'th column. The term Fmnm'n' represents a decay rate (decay of the light) of the light emission area in the mth row and nth column, generated due to the light emitted from the light emission area located in the m'th row and n'th column, the decay rate being obtained from the diffusion information. The term BDm'n' represents the emission brightness of the light emission area located in the m' th row and n'th column.

$$Kmnm'n'=Fmnm'n'\times BDm'n' \quad \text{(Equation 7)}$$

The diffusion information indicates the decay rate shown in, for example, a light emission area, which is generated due to the light emitted from one certain light emission area. The decay rate is a value of 0 to 1. When the value of the decay rate is 1, it means that, the light has not decayed. When the value of the decay rate is 0, it means that the light, no longer exists. The decay rate Fmnm'n' can be obtained by setting the position of the abovementioned certain light emission area in the m'th row and n' th column.

FIG. 6 shows the decay rate shown in each light emission area that is generated due to the light emitted by, for example, the light emission area located in the 1st row and 1st column. In the example shown in FIG. 6, the decay rate shown in the light emission area in the 1st row and 1st column is 1, and a value of the decay rate reduces while moving away from the light emission area located in the 1st row and 1st column, which means that the light decays while moving away from the light emission area located in the 1st row and 1st column. Consequently, the value of the decay rate drops as the light moves away from the light emission area in the 1st row and 1st column.

Note that the diffusion information is not limited to the information described above. For instance, the diffusion information may be in the form of a table or function representing the relationship between the distance between light emission areas and the decay rate. In this case, the decay rate Fmnm'n' can be calculated, from the distance between the light emission area located in the m'th row and n'th column and the light emission area located in the mth row and nth column.

Subsequent to calculation of brightness K of the light emitted from all of the light emission areas other than the target light emission area, the procedure proceeds to S2012.

In the next step S2012, the light leakage rate calculation unit 201 calculates a total value SDmn of the brightness K generated in the target light emission area due to the light emitted from the light emission areas other than the target light emission area. The total value SDmn is calculated using Equation 8.

In S2013, the light leakage rate calculation unit 201 calculates the ratio of the total value SDmn to the sum of the emission brightness BDmn of the target light emission area and the total value SDmn as the light leakage rate αmn of the target light emission area. The light leakage rate αmn is calculated using Equation 9.

$$\alpha mn=SDmn/(BDmn+SDmn) \quad \text{(Equation 9)}$$

In the subsequent step S2014, the light leakage rate calculation unit 201 outputs the calculated light leakage rate αmn to the emission color table calculation unit 202.

The plurality pieces of emission color information (the plurality of emission color tables) prepared beforehand are stored in the emission color table storage unit 102. The plurality of pieces of emission color information correspond to the plurality of combinations of emission brightness of the light emission areas. Specifically, first emission color information and second emission color information are stored in the emission color storage unit 102. The first emission color information indicates an emission color of a light emission area for setting the color thereof as a predetermined color (white, in the present embodiment), the emission color being based on the assumption that light does not leak from the other light emission areas. Particularly, the first emission color information is an emission color table TBL0 set. for each light emission area and indicating the emission color of each light emission area for setting the color thereof as the predetermined color, the emission color being obtained when only this light emission area is caused to emit light (at the maximum emission brightness). The second emission color information indicates an emission color of a light emission area for setting the color thereof as the predetermined color, the emission color being based on the assumption that the largest amount of light leaks from the other light emission areas. Particularly, the second emission color information is an emission color table TBL1 set for each light emission area and indicating the emission color of each light emission area for setting the color thereof as the predetermined color, the emission color being obtained when all of the light emission areas are caused to emit light (at the maximum emission brightness).

The emission color table calculation unit 202 acquires the emission color information from the emission color table storage unit 102. The emission color table calculation unit 202 then sequentially sets the light emission areas as target light emission areas and corrects, based on the light leakage rate α, the emission colors of the target light emission areas indicated by the emission color information. Specifically, based on the light leakage rate α, the emission color table calculation unit 202 weights and synthesizes the plurality of emission colors of the target, light emission areas indicated by the plurality of pieces of emission color information.

The corrected (weighted and synthesized) emission colors are sent to the LED controller 104. By means of the same processes as those described in Embodiment 1, the light emission areas are then caused to emit light of the corrected emission colors.

Figure 7:
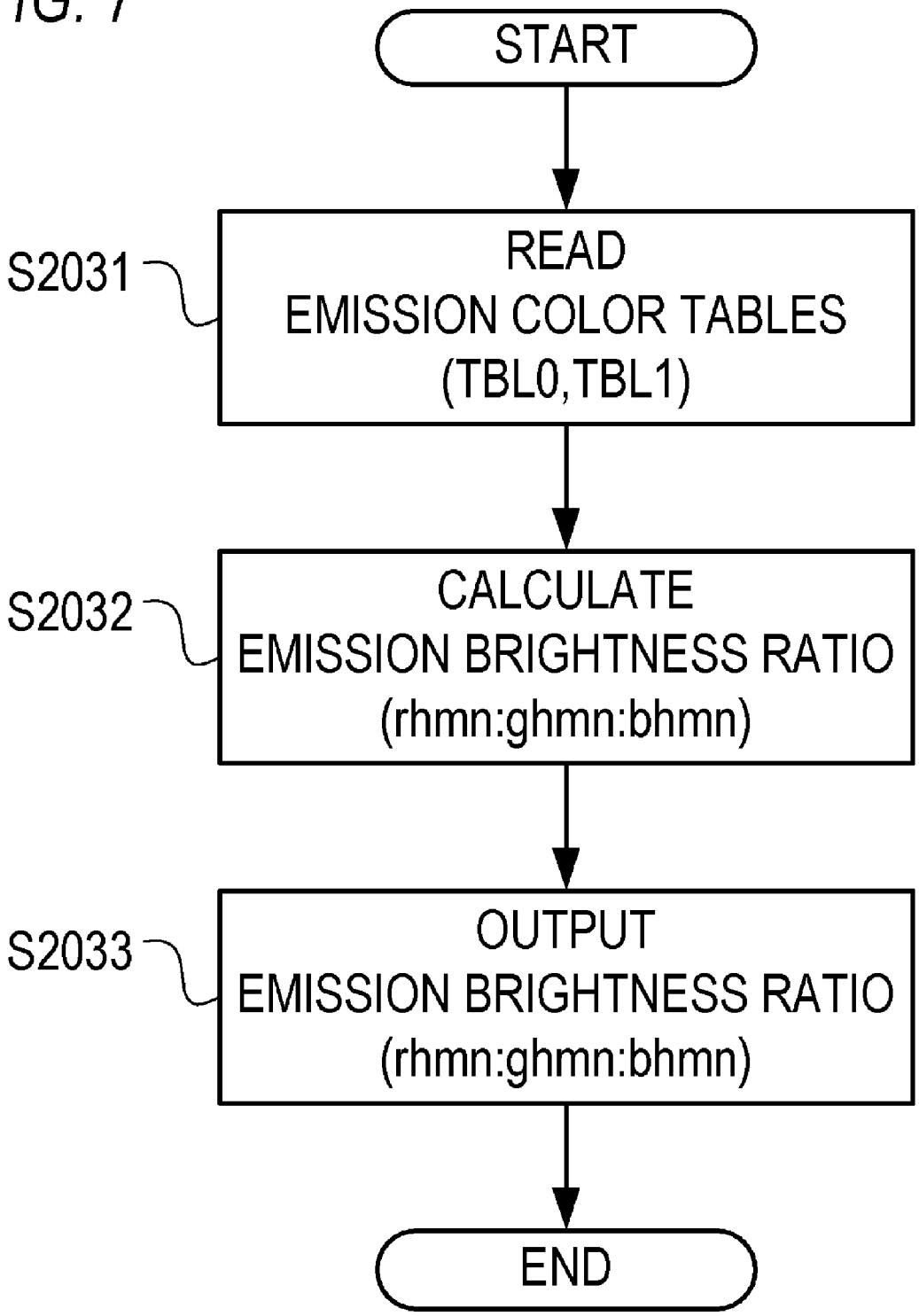
FIG. 7 is a flowchart showing an example of a flow of processes executed by an emission color table calculation unit.

FIG. 7 is a flowchart showing an example of a flow of processes executed by the emission color table calculation unit 202.

The following describes a process flow for calculating the emission color (emission brightness ratio) of the target light emission area located in the mth row and nth column. The emission color table calculation unit 202 executes the following processes on all of the light emission areas.

First of all, in S2031 the emission color table calculation unit 202 reads the emission color tables TBL0, TBL1 from the emission color table storage unit 102.

In the next step S2032, the emission color table calculation unit 202 calculates the final emission brightness ratio by using the emission color tables TBL0, TBL1read in S2031 and the light leakage rate αmn. Specifically, the final emission brightness ratio is calculated by weighting and synthesizing the emission brightness ratio of the target light emission area represented by the emission color table TBL0 and the emission brightness ratio of the target light, emission area represented by the emission color table TBL1, using a weight corresponding to the light leakage rate αmn. In the present embodiment, the final emission brightness ratio is calculated using the following equations 10 to 14.

The term ri0mn represents emission brightness of the red LED of the light emission area in the mth row and nth column, the emission brightness being represented by the emission color table TBL0. The term gi0mn represents emission brightness of the green LED of the light emission area in the mth row and nth column, the emission brightness being represented by the emission color table TBL0. The term bi0mn represents emission brightness of the blue LED of the light emission area in the mth row and nth column, the emission brightness being represented by the emission color table TBL0. The term s0mn represents the sum of the emission brightness ri0mn, gi0mn, and bi0mn.

The terra ri1mn represents emission brightness of the red LED of the light emission area in the mth row and nth column, the emission brightness being represented by the emission color table TBL1. The term gi1mn represents emission brightness of the green LED of the light emission area in the mth row and nth column, the emission brightness being represented by the emission color table TBL1. The term bi1mn represents emission brightness of the blue LED of the light emission area in the mth row and nth column, the emission brightness being represented by the emission color table TBL1. The term s1mn represents the sum. of the emission brightness ri1mn, gi1mn, and bi1mn.

The term rhmn represents final emission brightness (relative value) of the red LED of the light emission area in the mth row and nth column. The term ghmn represents final emission brightness (relative value) of the green LED of the light emission area in the mth row and nth column . The term bhmn represents final emission brightness (relative value) of the blue LED of the light, emission area in the mth row and nth column. The "ratio of the final emission brightness" is expressed as rhmn:ghmn:bhmn.

$$s0mn=ri0mn+gi0mn+bi0mn \quad \text{(Equation 10)}$$

$$s1mn=ri1mn+gi1mn+bi1mn \quad \text{(Equation 11)}$$

$$rhmn=(ri0mn/s0mn)\times(1-\alpha mn)+(ri1mn/s1mn)\times\alpha mn \quad \text{(Equation 12)}$$

$$ghmn=(gi0mn/s0mn)\times(1-\alpha mn)+(gi1mn/s1mn)\times\alpha mn \quad \text{(Equation 13)}$$

$$bhmn=(bi0mn/s0mn)\times(1-\alpha mn)+(bi1mn/s1mn)\times\alpha mn \quad \text{(Equation 14)}$$

S2033 the emission color table calculation unit 202 outputs the emission brightness ratio (rhmn:ghmn:bhmn) calculated, in S2032 to the LED controller 104.

The effects of the present embodiment are described next. Specifically, next is described the fact that the use of the emission brightness ratio calculated in the process flow of FIG. 7 can suppress a change in color of each light emission area caused by a change in emission brightness of each light emission area. Here is described an example in which the emission brightness of each light emission area is expressed by the emission state 1018 (FIG. 2).

Figure 8:
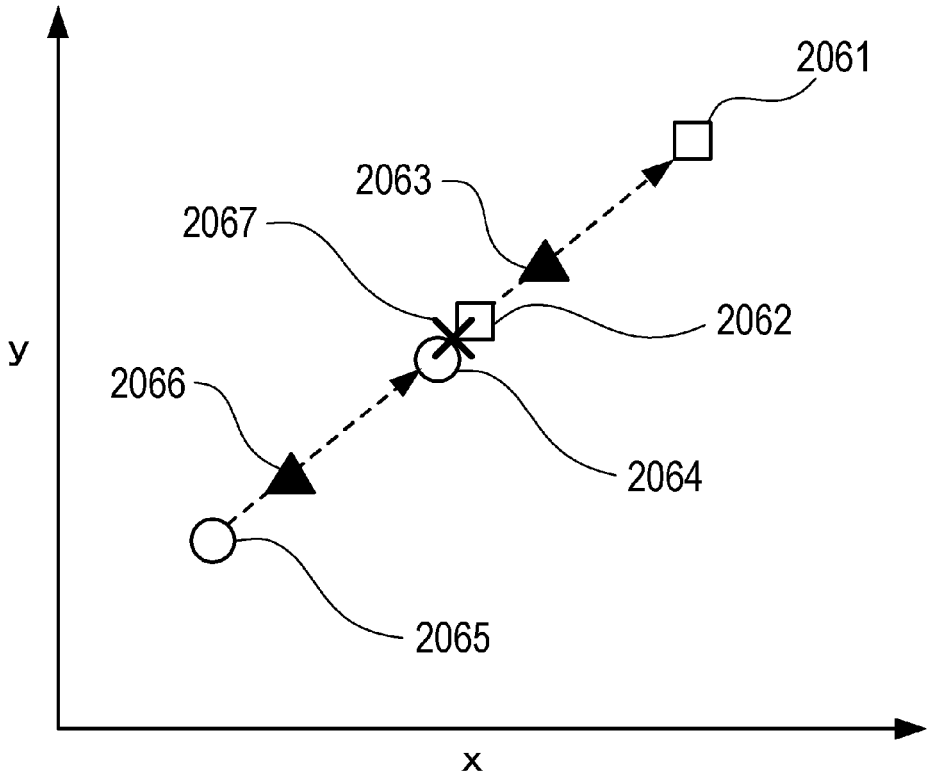
FIG. 8 is a diagram for explaining the effects of Embodiment 2.
Figure 9A:
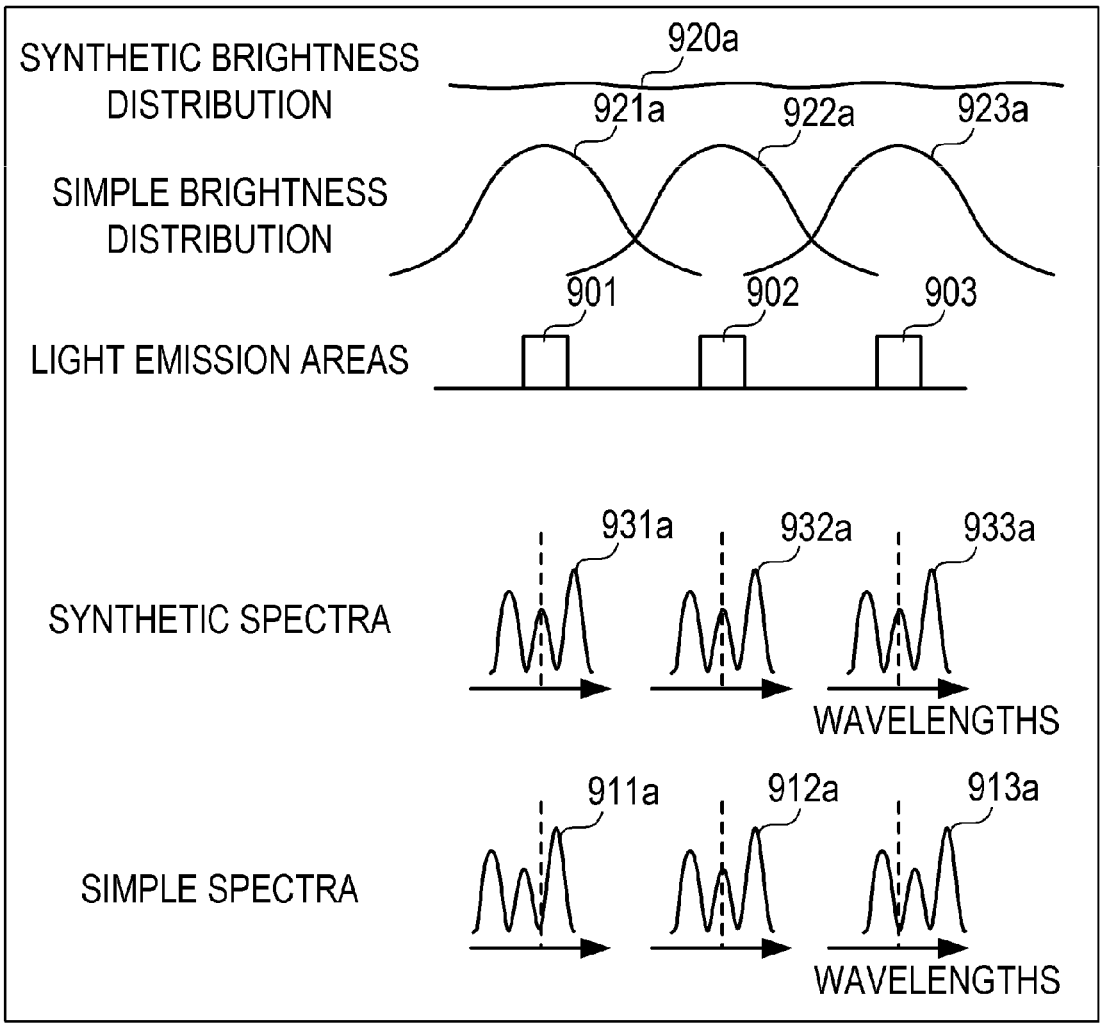
FIGS. 9A and 9B are diagrams for explaining a change in color of a light emission area that is caused as a result of a change in its emission brightness.
Figure 9B:
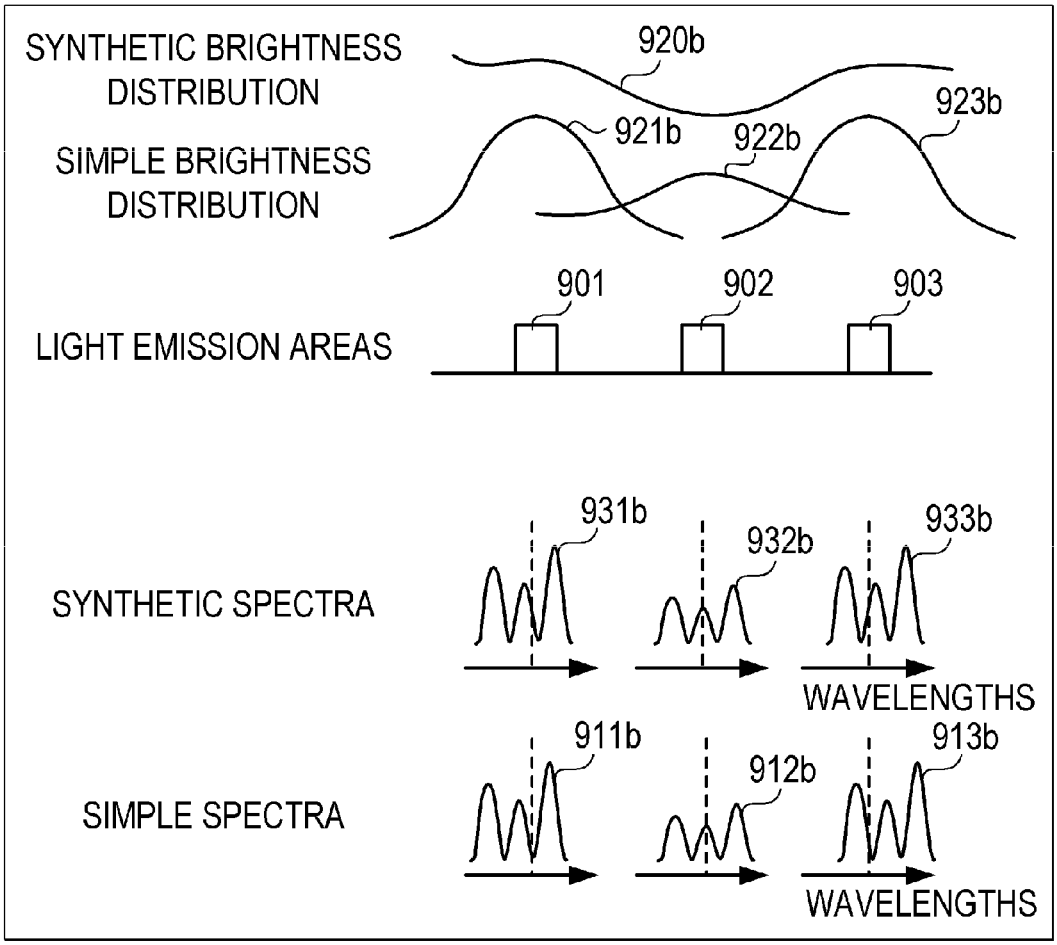

FIG. 8 is a chromaticity graph showing an example of the effects of the present embodiment. The graph shown in FIG. 8 has an abscissa showing an x value and a vertical axis showing a y value.

A chromaticity coordinate 2061 indicates the color of the light emission area 1019 (light emission area 1020) shown in FIG. 2 that is obtained when the emission brightness of each light emission area is at the maximum level and when the emission color of each light emission area is the emission color of the emission color table TBL0. The emission color of the emission color table TBL0 is obtained based on the assumption that only one light emission area is caused to emit light at the maximum emission brightness. Thus, the chromaticity coordinate 2061 shows a color that differs significantly from the desired color (the predetermined color: white, in the present embodiment).

A chromaticity coordinate 2062 indicates the color of the light emission area 1019 obtained when only the light emission area 1019 is caused to emit light in an emission color of the emission color table TBL0 at the maximum emission brightness. The emission color of the emission color table TBL0 is obtained based on the assumption that only one light emission area is caused to emit light at the maximum emission brightness. Thus, the chromaticity coordinate 2062 shows the desired color.

When the light emission areas have fixed emission colors (the emission colors of the emission color table TBL0), the colors (chromaticity coordinates) of the light emission areas fluctuate depending on the emission states of the light emission areas.

A chromaticity coordinate 2063 indicates the color of the light emission area 1019 obtained when the emission brightness of each light emission area is expressed by the emission state 1018 and when the emission color (emission brightness ratio) of each light emission area is shown by the emission color table TBL0. The difference between the emission state 1018 and the emission state where only the light emission area 1019 is caused to emit light is smaller than the difference between the emission state 1018 and the emission state where all of the light emission areas are caused to emit light. Consequently, the difference between the chromaticity coordinate 2063 and the chromaticity coordinate 2062 is smaller than the difference between the chromaticity coordinate 2063 and the chromaticity coordinate 2061. In other words, the chromaticity coordinate 2063 shows a color similar to that shown by the chromaticity coordinate 2061.

A chromaticity coordinate 2064 indicates the color of the light, emission area 1019 obtained when the emission brightness of each light emission area is at the maximum level and when the emission color of each light emission area is shown by the emission color table TBL1. The emission colors of the emission color table TBL1 are obtained based on the assumption that the light emission areas are caused to emit light at the maximum emission brightness. Thus, the chromaticity coordinate 2064 shows the desired color.

A chromaticity coordinate 2065 indicates the color of the light emission area 1019 obtained when only the light emission area 1019 is caused to emit light in an emission color of the emission color table TBL1 at the maximum emission brightness. The emission colors shown by the emission color table TBL1 are obtained based on the assumption that the light emission areas are caused to emit light at the maximum emission brightness. Thus, the chromaticity coordinate 2065 shows a color that differs significantly from the desired color.

When the light emission areas have fixed emission colors (the emission colors of the emission color table TBL1), the colors (chromaticity coordinates) of the light emission areas fluctuate depending on the emission states of the light emission areas.

A chromaticity coordinate 2066 indicates the color of the light emission area 1019 obtained when the emission brightness of each light emission area is represented by the emission state 1018 and when the emission color (emission brightness ratio) of each light emission area is shown by the emission color table TBL1. The difference between the emission state 1018 and the emission state where only the light emission area 1019 is caused to emit light is smaller than the difference between the emission state 1018 and the emission state where all of the light emission areas are caused to emit light. Consequently, the difference between the chromaticity coordinate 2066 and the chromaticity coordinate 2065 is smaller than the difference between the chromaticity coordinate 2066 and the chromaticity coordinate 2064. In other words, the chromaticity coordinate 2066 shows a color similar to that shown by the chromaticity coordinate 2065.

Reference numeral 2067 represents a chromaticity coordinate showing the desired color.

In the present embodiment, the emission colors of the emission color table TBL0 and the emission colors of the emission color table TBL1 are weighted and synthesized in such a manner that the chromaticity coordinate 2067 becomes the final chromaticity coordinate. The weight applied here corresponds to the light leakage rate. Because the emission state 1018 is similar to the emission state in which only the light emission area 1019 is caused to emit, a value greater than the weight of the emission colors of the emission color table TBL1 is set as the weight of the emission colors of the emission color table TBL0, so that the final chromaticity coordinate is located between the chromaticity coordinate 2063 and the chromaticity coordinate 2066 (close to the chromaticity coordinate 2067).

According to the present embodiment, the level of influence of light from the light emission areas other than the target light emission area onto the color of the target light emission area is calculated based on the emission brightness of each light emission area that is determined by the emission brightness determination unit 101, as described above. Further, the emission color of the target light emission area, indicated by the emission color information, is corrected based on the level of influence described above. Consequently, each of the light emission areas is caused to emit light in the corrected emission color. This configuration can suppress a change in color of each light emission area, which is caused by a change in emission brightness of each light emission area.

Note that the present embodiment has described an example in which the first emission color information and the second emission color information are prepared in advance as the emission color information and the emission color indicated by the first emission color information and the emission color indicated by the second emission color information are weighted and synthesized; however, the configuration of the present embodiment is not limited thereto. For instance, three or more pieces of emission color information corresponding to three or more types of emission states may be prepared in advance as the emission color information. Then, the three or more pieces of emission color information may be weighted and synthesized. Alternatively, one piece of emission color information corresponding to one emission state may be prepared in advance as the emission color information. In other words, for each of the light emission areas, the emission color information that indicates the emission color of each light emission area for selling its color as a predetermined color may be prepared in advance, the emission color being obtained when creating a predetermined combination of emission brightness of the light emission areas. The emission color of the target light emission area indicated by the emission color information may be corrected in accordance with the difference between the level of influence generated when causing each light emission area to emit light at the emission brightness determined by the emission brightness determination unit 101 (the level of influence of the light from the light emission areas other than the target light emission area onto the color of the target light emission area) and the level of influence generated when causing each light emission area to emit light based on the predetermined combination.

Note that Equation 9 is not the only way to calculate $\alpha$. For example, $\alpha mn$ may be calculated using by the following equation 15.

$$\alpha mn = BDmn/(BDmn+SDmn) \quad \text{(Equation 15)}$$

In this case, rhmn, ghmn and bhmn are calculated, using the following equations 16 to 18.

$$rhmn = (ri0mn/s0mn)\times\alpha mn + (ri1mn/s1mn)\times(1-\alpha mn) \quad \text{(Equation 16)}$$

$$ghmn = (gi0mn/s0mn)\times\alpha mn + (gi1mn/s1mn)\times(1-\alpha mn) \quad \text{(Equation 17)}$$

$$bhmn = (bi0mn/s0mn)\times\alpha mn + (bi1mn/s1mn)\times(1-\alpha mn) \quad \text{(Equation 18)}$$

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-219400, filed on Oct. 1, 2012, which is hereby incorporated by reference herein in its entirety.

What is claimed is:

1. A light source apparatus formed of a plurality of light emission areas capable of individually controlling emission brightness and emission colors thereof, the light source apparatus comprising:

a brightness determination unit configured to determine emission brightness of each of the light emission areas;

a determination unit configured to determine whether a color of a target light emission area, which is one of the light emission areas, changes by changes in emission brightnesses of light emission areas other than the target light emission area, based on the emission brightness of each of the light emission areas determined by the brightness determination unit;

a color determination unit configured to determine an emission color of each of the light emission areas based on a determination result by the determination unit; and a control unit configured to cause each of the light emission areas to emit light of the emission color determined by the color determination unit, at the emission brightness determined by the brightness determination unit, wherein in a case where the determination unit determines that the color of the target light emission area changes, the color determination unit determines the emission color of the target light emission area in such a manner so as to suppress the change in the color of the target light emission area.

2. The light source apparatus according to claim 1, wherein the light source apparatus is used in a display apparatus, and the brightness determination unit determines the emission brightness of each of the light emission areas based on an input image of the display apparatus.

3. The light source apparatus according to claim 1, wherein emission color information indicating the emission color of each of the light emission areas is prepared in advance with respect to each combination of emission brightnesses of light emission areas, the determination unit selects emission color information corresponding to a combination of the emission brightnesses of the light emission areas determined by the brightness determination unit, and the color determination unit determines the emission color of each of the light emission areas according to the emission color information selected by the determination unit.

4. The light source apparatus according to claim 3, wherein the emission color information is prepared with respect to all combinations of the emission brightnesses of the light emission areas.

5. The light source apparatus according to claim 1, wherein, for each of the light emission areas, emission color information indicating the emission color of each of the light emission areas for setting a color thereof as a predetermined color is prepared in advance, the emission color being obtained in a case of creating a predetermined combination of emission brightnesses of the light emission areas, the determination unit calculates a level of influence of light of the light emission areas other than the target light emission area onto the color of the target light emission area, based on the emission brightness of each of the light emission areas determined by the brightness determination unit, the color determination unit corrects the emission color of the target light emission area indicated by the emission color information, based on the level of influence, and the control unit causes each of the light emission areas to emit light of the emission color corrected by the color determination unit.

6. The light source apparatus according to claim 5, wherein a plurality of emission color information items are prepared in advance for a plurality of combinations of emission brightnesses of the light emission areas, the color determination unit weights and synthesizes a plurality of emission colors of the target light emission area indicated by the plurality of emission color information items, based on the level of influence, and the control unit causes each of the light emission areas to emit light of the emission color resulting from weighting and synthesizing by the color determination unit.

7. The light source apparatus according to claim 6, wherein the plurality of emission color information items include, for each of the light emission areas:

first emission color information indicating the emission color of each of the light emission areas for setting a color thereof as a predetermined color, the emission color being obtained in a case of causing only this light emission area to emit light; and second emission color information indicating the emission color of each of the light emission areas for setting a color thereof as a predetermined color, the emission color being obtained in a case of causing all of the light emission areas to emit light.

8. The light source apparatus according to claim 5, wherein the level of influence represents a ratio of a total value of brightness that is generated in the target light emission area due to light emitted by the light emission areas other than the target light emission area, to a sum of the emission brightness of the target light emission area and the total value of brightness that is generated in the target light emission area due to light emitted by the light emission areas other than the target light emission area.

9. The light source apparatus according to claim 8, wherein diffusion information indicating how light of the light emission areas diffuses is prepared in advance, and the determination unit calculates the brightness that is generated in the target light emission area due to light emitted by the light emission areas other than the target light emission area, from the emission brightness of each of the light emission areas determined by the brightness determination unit and the diffusion information.

10. The light source apparatus according to claim 1, wherein each of the light emission areas has a plurality of light emitting elements generating different emission colors, and the emission color of each of the light emission areas is expressed by a ratio of emission brightness among the plurality of light emitting elements of the light emission area.

11. The light source apparatus according to claim 10, wherein the plurality of light emitting elements are a plurality of LEDs emitting light of different wavelengths.

12. A control method of a light source apparatus formed of a plurality of light emission areas capable of individually controlling emission brightness and emission colors thereof, the control method comprising:

determining emission brightness of each of the light emission areas;

determining whether a color of a target light emission area, which is one of the light emission areas, changes by changes in emission brightnesses of light emission areas other than the target light emission area, based on the determined emission brightness of each of the light emission areas;

determining an emission color of each of the light emission areas based on a determination result as to whether the color of the target light emission area changes; and causing each of the light emission areas to emit light of the determined emission color, at the determined emission brightness, wherein in a case where it is determined that the color of the target light emission area changes, the emission color of the target light emission area is determined in such a manner so as to suppress the change in the color of the target light emission area.

13. The control method of the light source apparatus according to claim 12, wherein the light source apparatus is used in a display apparatus, and the emission brightness of each of the light emission areas is determined based on an input image of the display apparatus.

* * * * *